US006045414A

United States Patent [19]

DeFrance

[11] Patent Number: 6,045,414

[45] Date of Patent: Apr. 4, 2000

[54] VISE CONNECTOR

[75] Inventor: Robert DeFrance, Poughkeepsie, N.Y.

[73] Assignee: Maclean Power Systems, Franklin Park, Ill.

[21] Appl. No.: 09/267,210

[22] Filed: Mar. 12, 1999

[51] Int. Cl.[7] ..... H01R 11/09

[52] U.S. Cl. ..... 439/794; 439/790; 439/797; 439/801

[58] Field of Search ..... 439/794, 797, 439/790, 776, 801, 811, 812, 781, 782

[56] References Cited

U.S. PATENT DOCUMENTS

| | | | |
|---|---|---|---|
| 2,219,846 | 10/1940 | Meyer . | |
| 2,858,522 | 10/1958 | Wengen et al. | 339/264 |
| 2,953,771 | 9/1960 | Kussy . | |
| 3,339,174 | 8/1967 | Walter et al. | 339/244 |
| 3,425,028 | 1/1969 | Neaderland . | |
| 4,640,571 | 2/1987 | Walter et al. . | |
| 4,985,003 | 1/1991 | Francois et al. . | |
| 5,041,012 | 8/1991 | Caprio | 439/413 |
| 5,423,699 | 6/1995 | Johnson | 439/783 |
| 5,593,327 | 1/1997 | Hinsky et al. | 439/811 |

*Primary Examiner*—Lincoln Donovan
*Assistant Examiner*—Richard K. Lee
*Attorney, Agent, or Firm*—Pitney, Hardin, Kipp & Szuch, LLP

[57] ABSTRACT

The electrical connector includes a male element traveling within a female element, the male element having a cantilevered C-clamp arm opposing a C-clamp element formed on the female element. A spacer includes a planar surface with a passageway through which at least a portion of the male and female elements pass thereby slidably interlocking the male and female element to each other. The spacer further includes a wire spacer which travels between the clamp arms and separates the conductors to be clamped. Ledges are formed on the male and female elements to limit travel of the male element with respect to the female element and to limit travel of the spacer with respect to the male element. A bolt passing through the female element and threadably engaging the male element secures the male element to the female element so that the clamp arms clamp conductors as separated by the wire spacer.

10 Claims, 2 Drawing Sheets

VISE CONNECTOR

BACKGROUND OF THE INVENTION

1. Field of the Invention

This invention pertains to an electrical connector with bolt-tightened male and female C-clamp elements and an encircling central spacer.

2. Description of the Prior Art

In the prior art, bolt-fastened electrical connectors are known. However, prior art electrical connectors typically have very loose fitting components. These loose fitting components can be the result of sand casting which typically requires a considerable amount of angular draft on the components. This can result in an increased angle of the vise-type momentum arm between the bolt-fastening mechanism and the vise mechanism which engages the electrical wires. Additionally, the loose fitting components of the prior art can result in incorrect installation. Similarly, the loose fitting components can cause disassembly during the installation process.

Some prior art of interest is U.S. Pat. No. 4,985,003 to Francois et al. entitled "Branching Electrical Connector and Spacer Therefor"; U.S. Pat. No. 4,640,571 to Walter et al. entitled "Electrical Connector Blocks"; U.S. Pat. No. 3,425,028 to Neaderland entitled "Clamp Connector"; U.S. Pat. No. 2,953,771 to Kussy entitled "Electrical Connector"; and U.S. Pat. No. 2,219,846 to Meyer entitled "Tap Connector".

OBJECTS AND SUMMARY OF THE INVENTION

It is therefore an object of this invention to provide an electrical connector with tight tolerances between the components.

It is therefore a further object of this invention to provide an electrical connector with a reduced angle of the vise-type momentum arm between the bolt-fastening mechanism and the vise mechanism.

It is therefore a still further object of this invention to provide an electrical fastener which reduces or eliminates tendencies for improper assembly.

It is therefore a still further object of this invention to provide an electrical fastener which reduces or eliminates tendencies for disassembly during the installation process.

These and other objects are attained by providing an electrical connector with a male component traveling within a female component. A bolt tightens the male component against the female component further tightening a C-clamp structure with a first arm integral with the female element and a second arm integral with the male element. A spacer element includes a passageway through which the male and female components pass thereby acting as a lock ring which prevents disassembly during installation and assures proper assembly. The spacer element further includes a spacer which fits within the arms of the C-clamp structure.

The male component, the female component and the spacer element are formed by an extrusion process thereby allowing tight tolerances and reduced angle of the momentum arm between the bolt tightening mechanism and the C-clamp mechanism.

The back wall of the female component has a lip on the inside edge where the male rides against the back of the wall. The male component has a lip on the mating surface which interlocks with the female component. As the male component travels outwardly from the female component, the outer lip of the male component makes contact with the inner lip of the female component creating a locking feature. This prevents the male component from disengaging from the female component. The inner back wall of the female component further includes an oblique portion to aid in the initial assembly of the male and female components. The top of the outer back wall of the female component includes a lip to retain the spacer. The male component also has a lip on the wire groove side. This lip is designed to interlock with the spacer. The spacer has a rectangular passageway in the retaining flange that encircles the male component and the female component and further interlocks with the lip on the male component. As the male component travels outwardly from the female component, it engages with the spacer. The spacer then opens to allow for the installation of the conductor.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
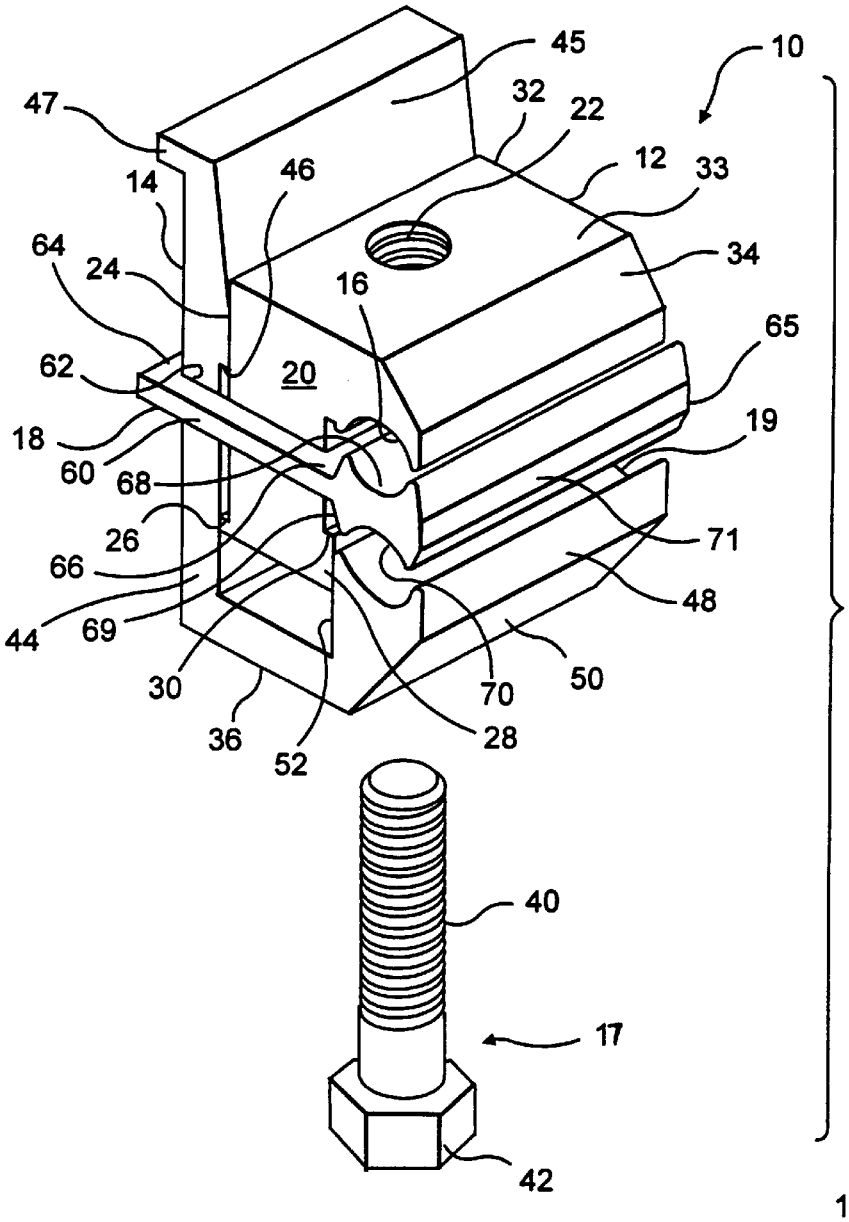
FIG. 1 is an exploded perspective view of the vise connector of the present invention.

Referring now to the drawings in detail wherein like numerals indicate like elements throughout the several views, one sees that FIG. 1 is an exploded perspective view of vise connector 10. Male element 12 travels within female element 14 and is secured thereto by bolt 17. Spacer 18 interlocks male element 12 to female element 14 and further acts as a spacer between C-clamp element 16 of male element 12 and C-clamp element 19 of female element 14. Due to the relatively tight tolerances required by vise connector 10, male element 12, female element 14 and spacer 18 are preferably metallic and formed by extrusion, although those skilled in the art will recognize that other production techniques are available.

Male element 12 includes body 20 with threaded aperture 22 through a central portion thereof. Rear face 24 of male element 12 includes ledge-shaped lip 26 to lock against female element 14 as will be described in detail hereinafter. Likewise, front face 28 of male element 12 includes ledge-shaped lip 30 to interlock with spacer 18 as will be described in detail hereinafter. Upper surface 32 of male element 12 includes level surface 33 and cantilevered bevel surface 34 which protrudes outwardly to form C-clamp element 16.

Figure 5:
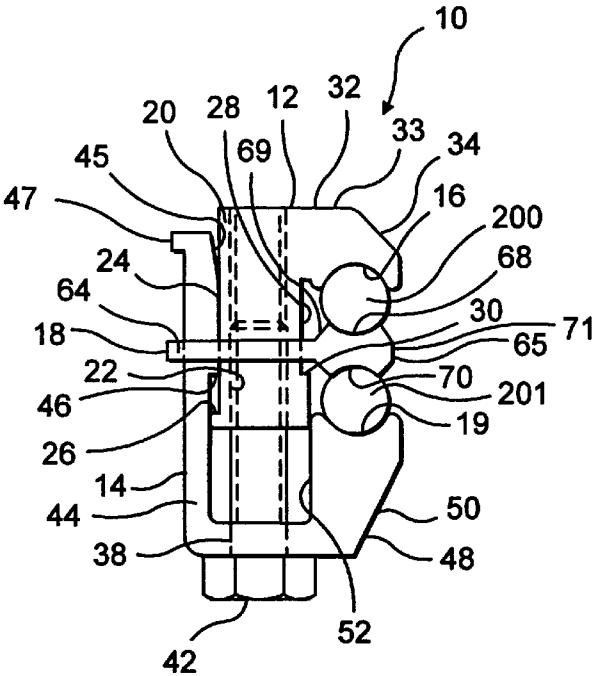
FIG. 5 is a plan view of the vise connector of the present invention in a closed position engaging conductors of a relatively large diameter.
Figure 4:
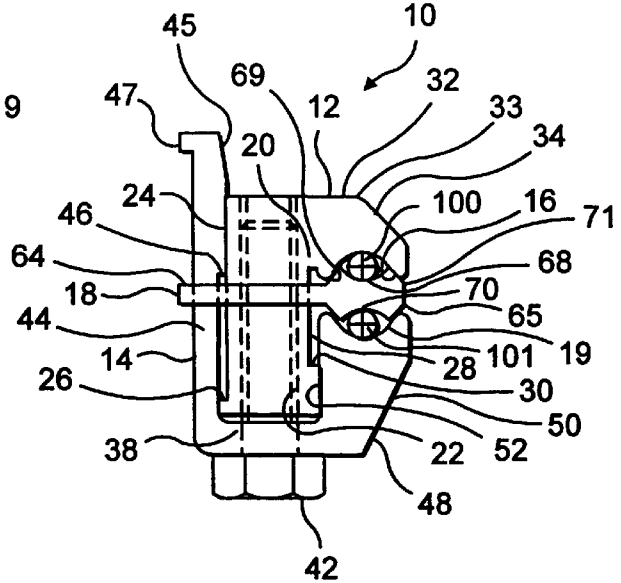
FIG. 4 is a plan view of the vise connector of the present invention in a closed position engaging conductors of a relatively small diameter.
Figure 3:
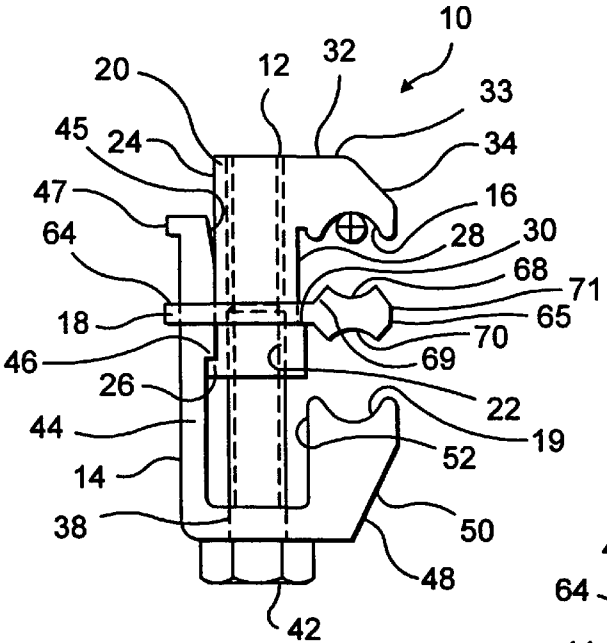
FIG. 3 is a plan view of the vise connector of the present invention in an open position.

Female element 14 includes base surface 36 with aperture 38 through which threaded section 40 of bolt 17 passes so that head 42 of bolt 17 is flush with base surface 36 (see FIGS. 3–5). Rear surface 44 of female element 14 is integral with base surface 36 and includes inner inverted ledge-shaped locking lip 46 to engage ledge-shaped lip 26 of rear face 24 of male element 12 thereby retaining male element 12, as constrained by spacer 18, in a fully open position as shown in FIG. 3. Male element 12 is not prone to disassembly from female element 14 in the configuration shown in FIG. 3. Rear surface 44 of female element 14 includes interior oblique surface 45 to aid in the initial assembly of male element 12 to female element 14. The top of rear surface of female element 14 further includes exterior lip 47 to limit upward movement of spacer 18.

Front surface 48 of female element 14 includes bevel surface 50 which protrudes outwardly to form C-clamp element 19 which opposes C-clamp element 16 of male element 12. Channel 52 is formed between rear surface 44 and front surface 48 of female element 14 and above base surface 36. Male element 12 travels within channel 52 (see FIGS. 3–5) from the open to the closed position.

Figure 2:
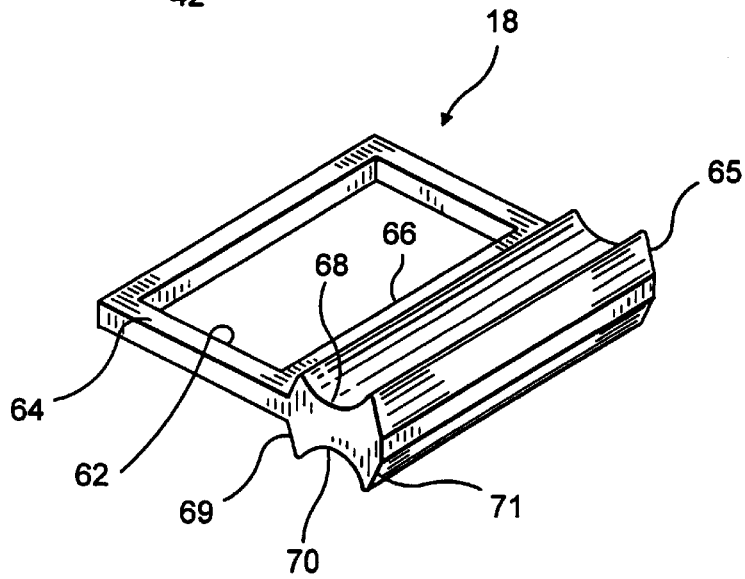
FIG. 2 is a perspective view of the spacer element of the vise connector of the present invention.

As shown in FIG. 2, spacer 18 includes retaining flange 60 formed by passageway 62 through planar surface 64. Passageway 62 is sized to slidably retain male element 12 to female element 14 as shown in FIGS. 3–5. Spacer 18 further includes wire spacer element 65 formed on a side 66 of retaining flange 60 with upper and lower concave surfaces 68, 70 configured to oppose C-clamp elements 16, 19, respectively. Lateral convex sides 69, 71 of wire spacer element 65 are shaped to accommodate the curvature as C-clamp elements 16–19 thereby allowing wire spacer 14 to become flush with C-clamp elements 16, 19 when engaging conductors 100, 101 of minimum diameter as shown in FIG. 4. The radius of curvature of upper and lower concave surfaces 68, 70, as well as that of C-clamp elements 16, 19 and lateral convex sides 69, 71, is preferably chosen to correspond to the radius of the maximum radius of engaged conductors 200, 201 as shown in FIG. 5. This radius of curvature further defines a minimum radius of engaged conductors 100, 101 as shown in FIG. 4.

As shown in FIG. 3, ledge-shaped lip 30 of front face 28 of male element 12 retains the travel of spacer 18 when male element 12 is in the relatively open position thereby further providing the interlocking function of spacer 18 between male element 12 and female element 14.

Typical assembly and installation procedures are given below. The order of the procedures, as well as the separation between the procedures, is somewhat arbitrary and may be varied for different applications.

To assemble vise connector 10, the assembler typically fits male element 12 through passageway 62 of spacer 18 and moves spacer 18 to a fully upward position so that upper concave surface 68 abuts against C-clamp element 16 of male element 12. The assembler then abuts male element 12 against interior oblique surface 45 of rear surface 44 of female element 14 and slips spacer 18 past exterior lip 47 of female element 14. The assembler then urges male element 12 to an upright position whereby ledge-shaped lip 26 of rear face 24 of male element 12 engages against inner inverted ledge-shaped locking lip 46 of rear surface 44 of female element 14. The assembler then lowers spacer 18 to the retaining position shown in FIG. 3. The assembler then inserts bolt 17 through aperture 38 of base surface 36 of female element 14 and threadably engages threaded section 40 of bolt 17 into threaded aperture of male element 22.

To install vise connector 10, conductors 100, 101 (FIG. 4) or 200, 201 (FIG. 5) or some size in-between are inserted into the spaces formed between upper concave surface 68 and C-clamp element 16 and lower concave surface 70 and C-clamp element 19, respectively. Bolt 17 is then tightened so that the conductors are tightly engaged by C-clamp elements 16, 19 against upper and lower concave surfaces 68, 70 as shown in FIGS. 4 and 5.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. An electric connector comprising:

a female element including a first clamp arm;

a male element including a second clamp arm opposing said first clamp arm, said male element traveling within said female element thereby varying a distance between said first clamp arm and said second clamp arm;

a spacer element including means for slidably interlocking said female element to said male element and further including a wire spacer positioned between said first clamp arm and said second clamp arm;

means for securing said male element with respect to said female element thereby fixing the distance between said first clamp arm and said second clamp arm;

wherein said spacer includes a planar portion with a passageway therethrough, and wherein said body of said male element and said rear wall of said female element passes through said passageway thereby forming said means for slidably interlocking said female element to said male element; and wherein an interior of said rear wall of said female element includes an inverted ledge and said rear surface of said body of said male element includes a first ledge which engages said inverted ledge when said male element is withdrawn a predetermined distance from said female element thereby limiting travel of said male element within said female element.

2. The electrical connector of claim 1 wherein said male element includes a body including a front surface and a rear surface and wherein said second clamp arm is cantilevered from said front surface.

3. The electrical connector of claim 2 wherein said female surface includes a base surface, a block upwardly extending from a front of said base surface and a rear wall extending upwardly from a rear of said base surface, said first clamp arm being formed on said block, and wherein said body of said male element travels within a gap formed between said block and said rear wall.

4. The electrical connector of claim 3 wherein said front surface of said body of said male element includes a second ledge for limiting downward movement of said spacer with respect to said male element.

5. The electrical connector of claim 4 wherein an upper portion of said interior of said rear wall of said female element includes an oblique wall portion and wherein an upper portion of an exterior of said rear wall of said female element includes a protruding lip.

6. The electrical connector of claim 5 wherein said wire spacer includes first and second concave portions and said first and second clamp arms include respective first and second clamp concave portions, wherein said first and second concave portions face respective said first and second concave clamp portions, and wherein said first and second concave portions and said first and second concave clamp portions have a common radius of curvature.

7. The electrical connector of claim 6 wherein said wire spacer includes convex lateral sides of said common radius of curvature.

8. The electrical connector of claim 7 wherein said common radius of curvature is equal to a maximum radius of conductor to be engaged between said wire spacer and one of said first and second clamp arms.

9. The electrical connector of claim 8 wherein said means for securing said male element with respect to said female element comprises an aperture in said base of said female element aligned with a threaded aperture in said body of said male element and a bolt, said bolt including a threaded section passing through said aperture and threadably engaging said threaded aperture.

10. The electrical connector of claim 9 wherein said male element, said female element and said spacer are formed from extruded metal.

* * * * *